US012605612B2

(12) United States Patent
Gammaro et al.

(10) Patent No.: US 12,605,612 B2
(45) Date of Patent: Apr. 21, 2026

(54) MODULAR SUPPORT AND STORAGE ASSEMBLY

(71) Applicant: GGPP Innovations, LLC, Nokomis, FL (US)

(72) Inventors: John J. Gammaro, Nokomis, FL (US); Gregory K. Wall, Sarasota, FL (US); David O'Meara, Venice, FL (US)

(73) Assignee: GGPP Innovations, LLC, Nokomis, FL (US)

( * ) Notice: Subject to any disclaimer, the term of this patent is extended or adjusted under 35 U.S.C. 154(b) by 0 days.

(21) Appl. No.: 18/792,780

(22) Filed: Aug. 2, 2024

(65) Prior Publication Data

US 2025/0041698 A1 Feb. 6, 2025

Related U.S. Application Data

(60) Provisional application No. 63/530,280, filed on Aug. 2, 2023.

(51) Int. Cl.
*A63B 71/02* (2006.01)
*A47G 29/08* (2006.01)
(Continued)

(52) U.S. Cl.
CPC ..... *A63B 71/023* (2013.01); *A47G 29/08* (2013.01); *A63B 61/02* (2013.01);
(Continued)

(58) Field of Classification Search
None
See application file for complete search history.

(56) References Cited

U.S. PATENT DOCUMENTS 738,850 A * 9/1903 Schug ..... E04H 12/2269 52/298
3,141,620 A * 7/1964 Guggemos ..... F21V 29/83 362/225

(Continued)

FOREIGN PATENT DOCUMENTS

CN 112152014 A 12/2020
WO 2010018237 A1 2/2010

OTHER PUBLICATIONS

Hydrotools by Swimline 89032 Free Standing Poolside Adjustable-Towel Rack With Water Weighted Base Three Arms Tier For Outdoors & Indoors Pool Patio Bathroom Poolside Accessory Holder Bar Drying-Stand Retrieved From: https://www.amazon.com/HYDROTOOLS-SWIMLINE-89032-Adjustable-Accessory/dp/B0032JSQNY?th=1.

(Continued)

*Primary Examiner* — Steven M Marsh
(74) *Attorney, Agent, or Firm* — Jeffrey B. Fabian; Shumaker, Loop & Kendrick, LLP

(57) ABSTRACT

A modular support and storage assembly that can be installed into a ground anchor hole. The assembly includes five support sleeves that are fixed into a base anchor. The support sleeves are housed inside a post. A skirt sits atop the base anchor. An upper collar and an upper anchor host are situated atop the support sleeves. An anchor element is inserted into and through the assembly and into a ground anchor hole and fixes the assembly to the ground. The assembly is modular in that one or more sub-assemblies can be used to accommodate varying numbers of support structures, such as swing arms that hold electronic devices, towels, beverages, and electronic devices.

20 Claims, 15 Drawing Sheets

(51) Int. Cl.
*A63B 61/02* (2006.01)
*A45B 23/00* (2006.01)

(52) U.S. Cl.
CPC ..... *A45B 2023/0012* (2013.01); *A45B 2023/0031* (2013.01); *A63B 2071/024* (2013.01)

(56) References Cited

U.S. PATENT DOCUMENTS

| | | | | |
|---|---|---|---|---|
| 4,043,132 | A | 8/1977 | Zupanick | |
| 4,813,657 | A | 3/1989 | Todd | |
| 5,632,464 | A * | 5/1997 | Aberle | E01F 9/685 52/298 |
| 5,657,972 | A | 8/1997 | Blatt | |
| 6,637,617 | B2 | 10/2003 | Eisenbraun et al. | |
| 6,732,485 | B2 | 5/2004 | Lett et al. | |
| 7,229,059 | B1 | 6/2007 | Hood | |
| 10,029,768 | B2 | 7/2018 | Marcireau | |
| 10,070,696 | B2 | 9/2018 | Miller et al. | |
| 10,457,071 | B2 | 10/2019 | Foley et al. | |
| 10,501,957 | B1 * | 12/2019 | Borowiak | E04H 12/22 |
| 2004/0129184 | A1 * | 7/2004 | Kraker | E04H 12/2223 108/50.12 |
| 2005/0039391 | A1 * | 2/2005 | Morse | A01K 63/006 47/39 |
| 2011/0170949 | A1 | 7/2011 | Gallardo | |
| 2012/0324825 | A1 * | 12/2012 | Vrame | E04H 12/2253 33/562 |
| 2016/0024741 | A1 * | 1/2016 | Brown | E04H 12/2253 52/295 |
| 2020/0324893 | A1 | 10/2020 | Mills et al. | |
| 2021/0031279 | A1 | 2/2021 | Galiber | |
| 2022/0074217 | A1 | 3/2022 | Hewitt et al. | |
| 2022/0276406 | A1 | 9/2022 | Lupini et al. | |

OTHER PUBLICATIONS

VolleyballUSA.com 1.9" O.D. Solid Aluminum Pool Volleyball System Retrieved From: https://www.volleyballusa.com/1-9-0-d-solid-aluminum-pool-volleyball-system/.

* cited by examiner

113

113

MODULAR SUPPORT AND STORAGE ASSEMBLY

CROSS-REFERENCE TO RELATED APPLICATION

This application claims priority to U.S. Provisional Patent Application Ser. No. 63/530,280 filed Aug. 2, 2023.

TECHNICAL FIELD AND BACKGROUND

The present invention relates to mechanical support and storage assemblies, and in particular, modular mechanical support and storage assemblies for accommodating various attachments that support and store a wide variety of objects.

A need may arise for temporary, robust storage and article support solutions when facilities are being utilized, such as working outdoors or engaging in water-based recreational activities by a pool. The storage and support should be portable, compact, and lightweight from one location to another as well as modular to support different types of objects with varying shapes and weights. The present assemblies provide solutions to meet the foregoing needs.

In particular, disclosed herein is a modular article support assembly called a "Poolside Placer Pin" that provide support to larger articles and attachments or functions as a standalone support assembly. The modular article support assembly installs within existing ground apertures, such as an anchor hole in a pool deck. The modular article support assembly can also be installed into newly created ground apertures, for example apertures made specifically for the modular article support assembly.

The modular article support assembly is configured to permit swapping various attachments, including, without limitation, towel racks; cellular phone or other mobile device holders; beverage holders; tabletops that span multiple assemblies; trays for holding food, tools, sunscreen, or other objects; and support posts for decorative or communicative objects, such signage bearing safety information, directional information, identifying information, or decorative flags for a favorite sports team or organization.

SUMMARY

The following discussion discloses and describes a modular article support assembly. An example embodiment of the modular article support assembly has a primary support sleeve and four secondary support sleeves that are each arranged adjacent to the primary support sleeve. In one embodiment, the four secondary support sleeves have cross-sectional dimensions smaller than the primary support sleeve. The primary support sleeve and the four secondary support sleeves are each coupled to five base anchor locking cavities housed in a base anchor situated at a bottom portion of the modular article support assembly.

The modular article support assembly has an upper collar secured into an upper anchor host situated at an upper portion of the modular article support assembly. A skirt is frictionally engaged and secured to the base anchor. A post having a rectangular cross section and a length houses the entire length of the secondary support sleeves and the primary support sleeve. The post is fixed to the base anchor and upper anchor host. When an elongated tubular anchor element is inserted through one of the four secondary support sleeves and into a ground aperture to secure the modular support assembly by preventing the modular support assembly from translating about a ground surface surrounding the ground aperture.

To add strength and make the assembly more rigid, a foam sealant can be applied to the negative space between the four secondary support sleeves, the one primary support sleeve and the post, the base anchor, the upper collar, and the upper anchor host. The four secondary support sleeves, the one primary support sleeve, and the post are comprised of polyvinyl chloride. The upper collar, the upper anchor host, and the base anchor are comprised of polyethylene terephthalate. Furthermore, one or more attachments can be inserted into one of the four secondary support sleeves or the one primary support sleeve. The attachment can be one of the following (i) a table or elongated arm; (ii) a straight rod or dowel like attachment; (iii) an elongated arm; (iv) basketball hoop; (v) volleyball net.

BRIEF DESCRIPTION OF THE FIGURES

Features, aspects, and advantages of the present invention are better understood when the following detailed description of the invention is read with reference to the accompanying figures.

DETAILED DESCRIPTION

Figure 1:
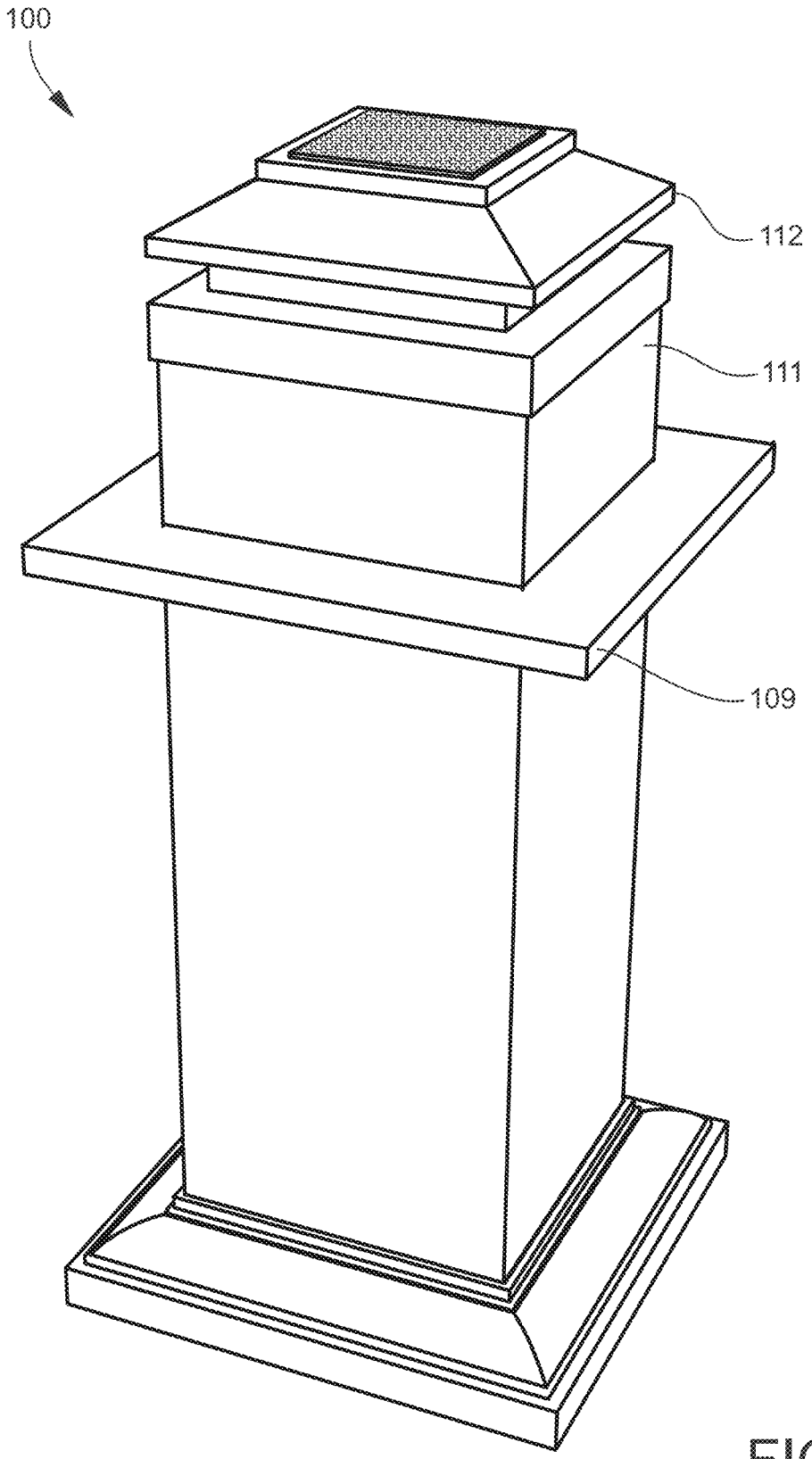
FIG. 1 is an image of an assembled modular article support assembly with a solar panel attachment.

The present invention will now be described more fully with reference to the accompanying pictures in which example embodiments of the invention are shown. However, the invention may be embodied in many different forms and should not be construed as limited to the representative embodiments set forth herein. The example embodiments are provided so that this disclosure will be both thorough and complete and will fully convey the scope of the invention to enable one of ordinary skill in the art to make, use, and practice the invention.

Relative terms such as lower or bottom; upper or top; upward, outward, or downward; forward or backward; and vertical or horizontal may be used herein to describe one element's relationship to another element illustrated in the figures. It will be understood that relative terms are intended to encompass different orientations in addition to the orientation depicted in the drawings. By way of example, if a component in the drawings is turned over, elements described as being on the "bottom" of the other elements would then be oriented on "top" of the other elements. Relative terminology, such as "substantially" or "about," describe the specified materials, steps, parameters, or ranges as well as those that do not materially affect the basic and novel characteristics of the claimed inventions as whole.

Any dimensions expressed or implied in the drawings and these descriptions are provided for example purposes. Thus, not all embodiments within the scope of the drawings and these descriptions are made according to such example dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

Disclosed herein are multiple embodiments of modular article support assemblies for various attachments to function as a support for a wide variety of articles, including, without limitation, towels, beverages, electronic devices, and many others. The modular article support assembly takes advantage of approximately ⅝ inch diameter holes drilled in most in-ground pool decks to install safety fencing that is generally required by law. Although the embodiments and figures illustrate the modular article support assembly with reference to supporting and storing objects near a pool, those of skill in the art will appreciate that the modular article support assembly can be utilized in various other surfaces and contexts, such as supporting tools, hardware, or other objects on a job site. The modular article support assembly also has a variety of commercial and non-commercial applications where it is advantageous to provide a portable support structure for useful articles, like tools, electronics, food and beverage items, and more. The support assembly finds utility in industries that include, but are not limited to, security services, sports and recreation, hospitality services, and restaurant services.

Figure 2:
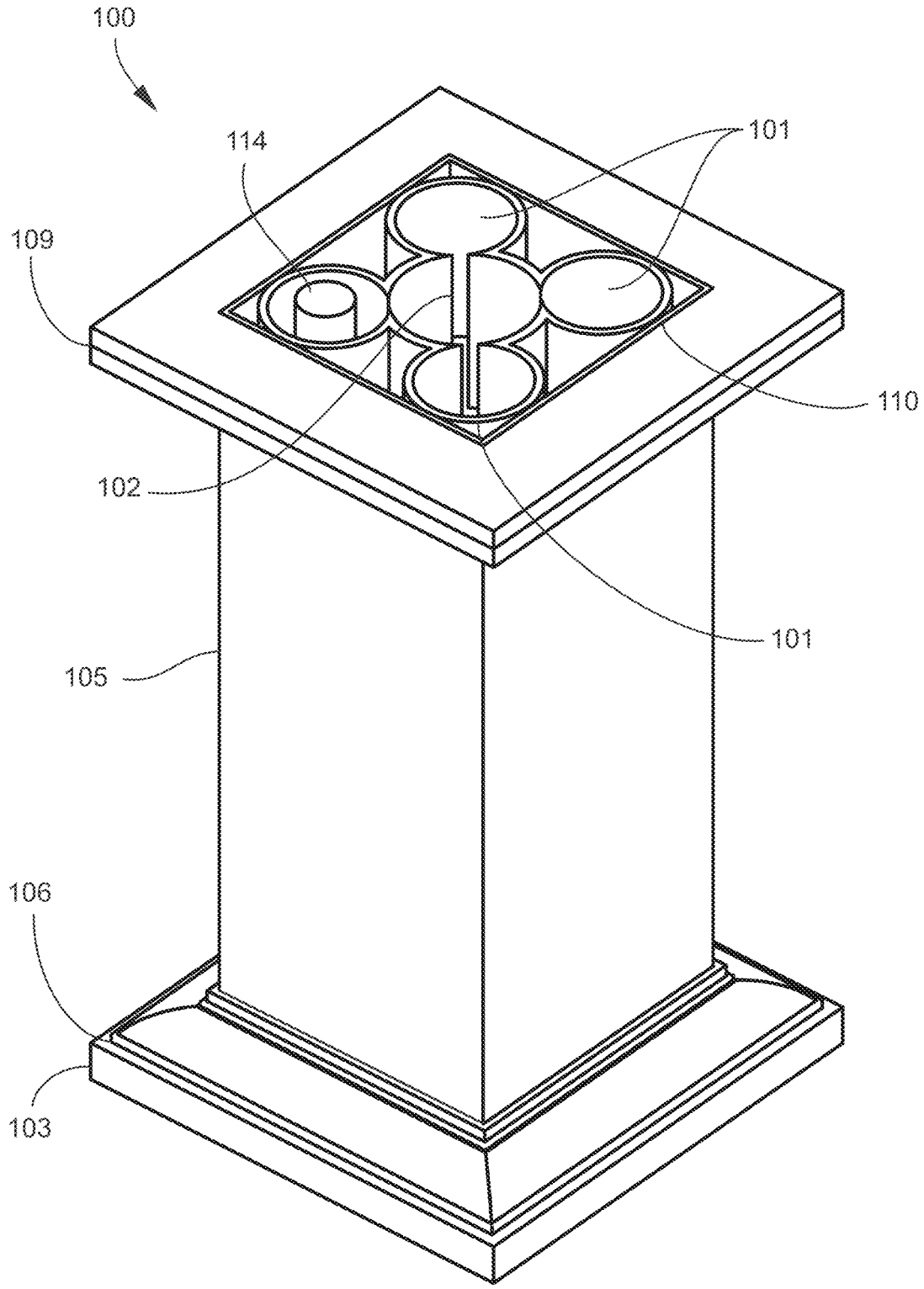
FIG. 2 is an angled top-down illustration of one embodiment of the modular article support assembly.

A first embodiment of a modular article support assembly 100 is shown in FIG. 1 wherein the modular article support assembly 100 has been inserted into a ground aperture and fixed to the ground. FIG. 2 is an illustration of a modular article support assembly 100 that includes four secondary support sleeves 101 and one primary support sleeve 102 that each have a first end or "base end" and a second end or "cap end." The first end of the support sleeves are releaseably coupled to the base anchor 103 (also called a "Pinster Foot") by being inserted into five base anchor locking cavities 104, as shown in more detail in FIG. 5.

The primary support sleeve 102 has a larger cross sectional area than the secondary support sleeve 101 to accommodate larger articles or heavier loads. The support sleeves 101 and 102 are housed inside a post or outer shell 105. A skirt 106 sits atop base anchor 103 in which the base anchor locking cavities 104 are formed.

Opposite base anchor 103 and situated atop the support sleeves at the second end, is an upper collar 107 and an upper anchor host 108. The upper anchor host 107 shown in the attached figures includes a central primary cutout to accommodate the primary support sleeve 102 and four secondary cutouts to accommodate the secondary support sleeves 101. The cutouts are formed with cross sectional areas that are the same shape as, but that are larger than, the cross sectional areas of the support sleeves. Thus, when the support sleeves are housed within the cutouts, there is a void between the outer surface of the support sleeve and the inner surface of the cutout.

The cutouts can optionally be formed with a height that allows the support sleeves to be housed within the cutouts at a predetermined depth from the top, outer surface of the cap. In other words, the support sleeves are inset a distance within the cutouts and sit below the top, outer surface of the cap. To support various articles, such as umbrellas, tables, or the like, the article is configured with a coupling element, such as an elongated rod, that is inserted into and housed within the support sleeves and/or the cutouts. In one embodiment, a first coupling element is inserted within a support sleeve to hold a first article, and a second coupling element is placed cover top of the first coupling element to become situated within the cutout and occupy the void. In this manner, a single sleeve and cutout can accommodate multiple articles or an extension of an existing article.

Figure 3:
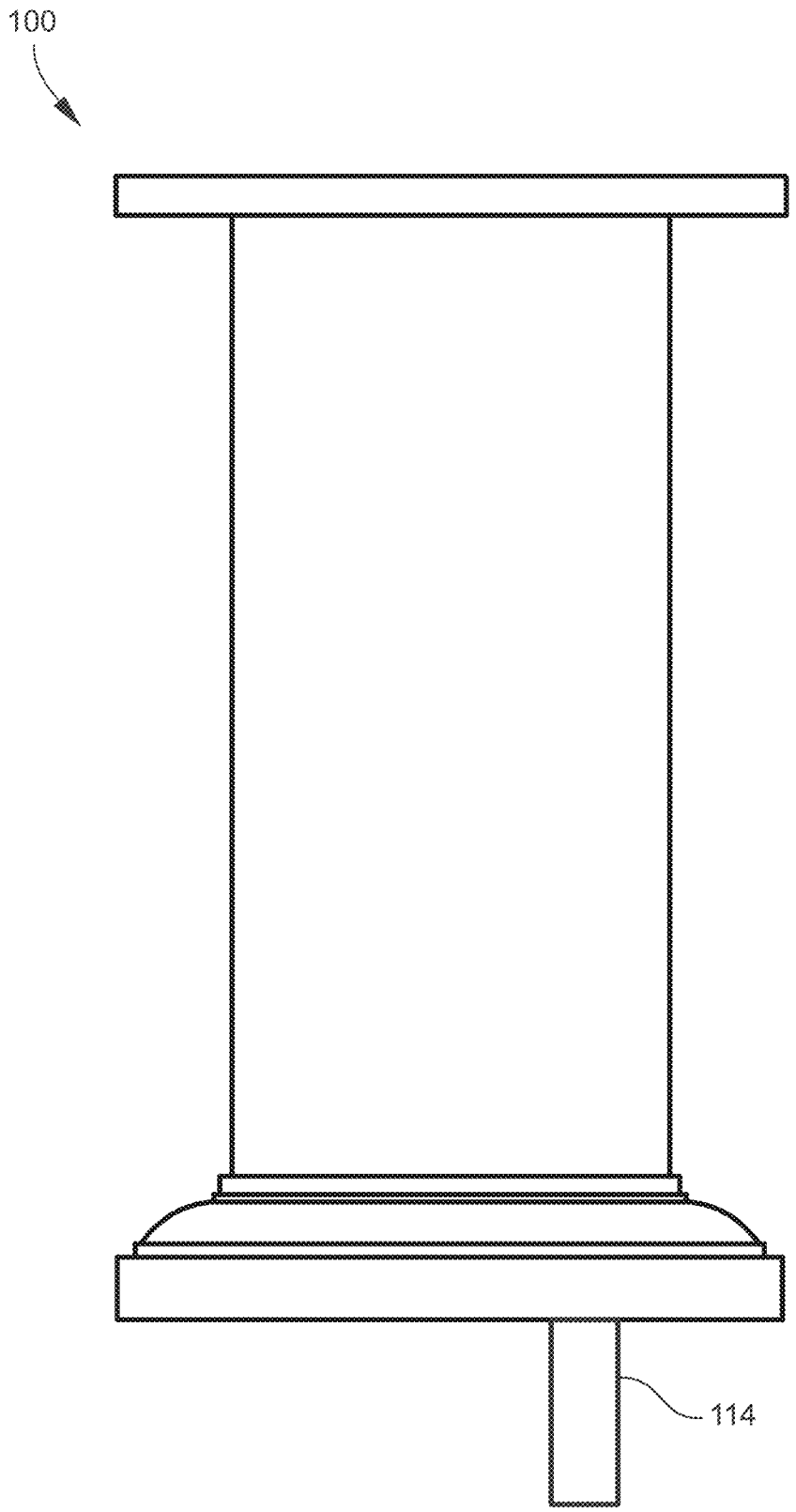
FIG. 3 is a side view of the modular article support assembly.
Figure 12A:
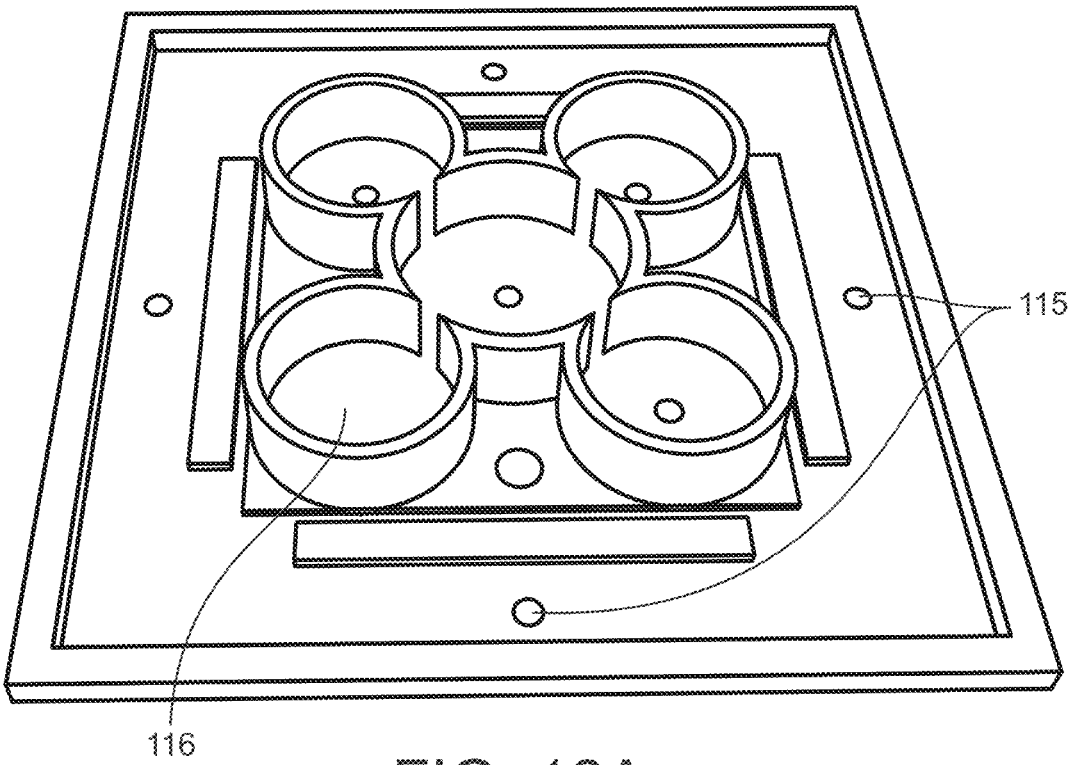
FIG. 12A is an image of the inside of an embodiment of the cap cover.
Figure 12B:
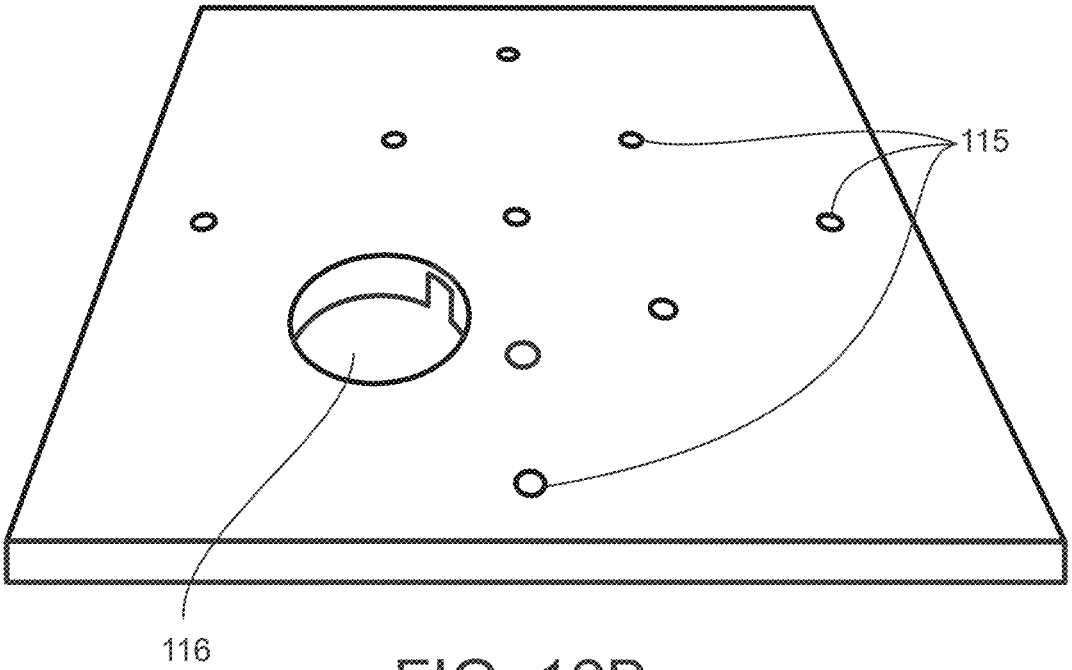
FIG. 12B is an image of the outside of an embodiment of the cap cover.

The upper collar 107 and the upper anchor host 108 can be two separate components or formed as one unitary component. The upper collar 107 and upper anchor host 108 are collectively referred to as the "Pinster Cap" 109 or the cap 109. The cap 109 includes a lip 110 in which a screen 111 can be placed. As seen in FIG. 1, a solar panel light attachment 112 is placed atop the lip and transforms the modular article support assembly 100 into an illumination assembly. Alternatively, a cap cover 113 (as depicted in FIGS. 12A-B) can be placed over the cap 109. In FIG. 3, an anchor element 114 is inserted into and through the modular article support assembly 100 and into a ground aperture, and thereby fixing the modular article support assembly 100 to the ground.

Figure 4A:
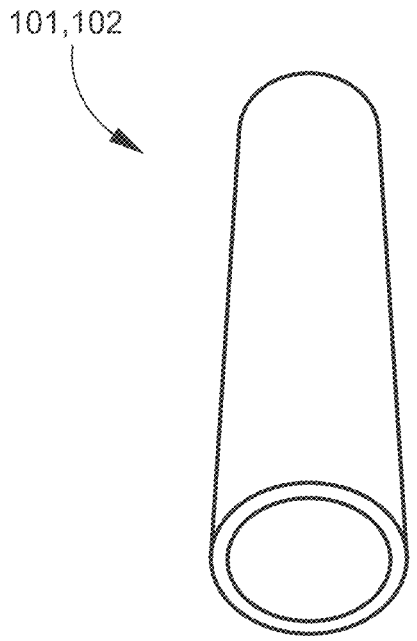
FIG. 4A is an example support sleeve.
Figure 4B:
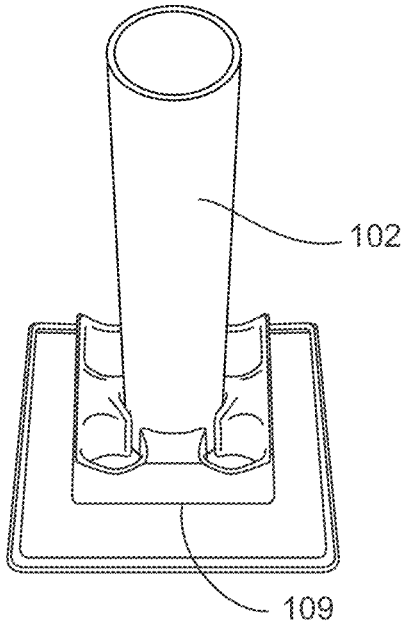
FIG. 4B is an image of the primary support sleeve secured into the base anchor.
Figure 4C:
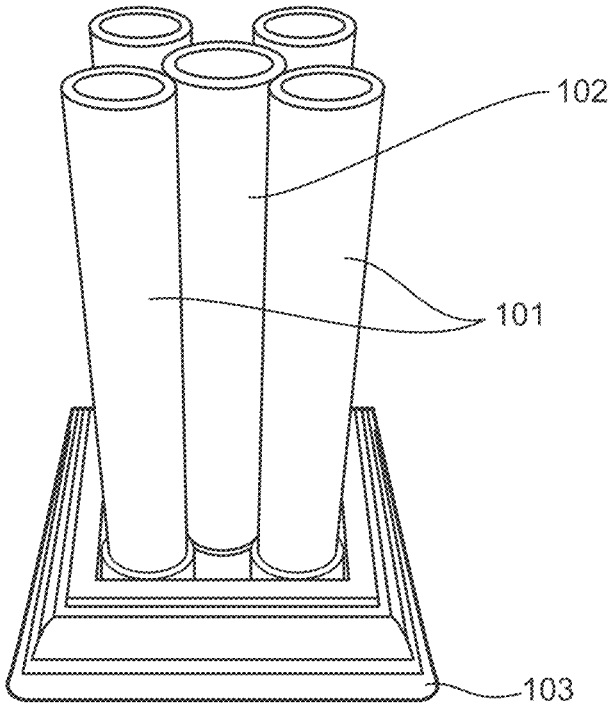
FIG. 4C is an image of all 5 support sleeves secured into the base anchor.

FIGS. 4A-C depicts the cap 109, base anchor 103, the four secondary support sleeves 101 (as depicted in FIG. 4A), and the one primary support sleeve 102 (as depicted in 4B). The support sleeves 101 and 102 are situated between the cap 109 and base anchor 103. The support sleeves 101 and 102 can be made of polyvinyl chloride ("PVC") which is a high-strength thermoplastic material. The PVC support sleeves 101 and 102 give structure, rigidity, and strength to the modular article support assembly 100. Additionally, the varying diameters allow for the accommodation of various sized attachments to be inserted into the support sleeves 101 and 102, as shown in FIGS. 14A-C and 15A-B. Those skilled in the art will appreciate that the support sleeves 101 and 102 can also be made of other materials, such as various metals and metal alloys.

The support assembly materials can incorporate various additives to enhance utility, durability, and performance. For example, the PVC composite material may incorporate an ultra violet ("UV") inhibitor additive that enhances resistance to damage from sunlight. Suitable UV light inhibitors can include, for instance, combinations of carbon black, rutile titanium oxide, hydroxybenzophenone, hydroxyphenylbenzotriazole, oxanilides for polyamides, benzophenones for PVC materials, and benzotriazoles and hydroxyphenyltriazines for polycarbonate materials, or Hindered Amine Light Stabilizers ("HALS"), among other compounds known to those of skill in the art. Suitable impact modifies can include, but are not limited to, acrylate monomers or acrylate polymers, methyl methacrylate, methyl methacrylate-butadiene-styrene ("MBS"), polybutyl acrylate ("PBA"), various polyacrylate polymers, nylon fibers, or carbon fibers.

The PVC composite can also incorporate particular pigments that provide color throughout the modular article support assembly. In this manner, the modular article support assembly maintains color not only from UV damage but also from mechanical damage (e.g., scratches, cracks, etc.) that might otherwise remove a color coating. In another example, the PVC composite can include flame retardants to impart fire resistance to the modular article support assembly or impact modifiers that enhanced the strength of the materials used to form the components of the system.

Figure 5:
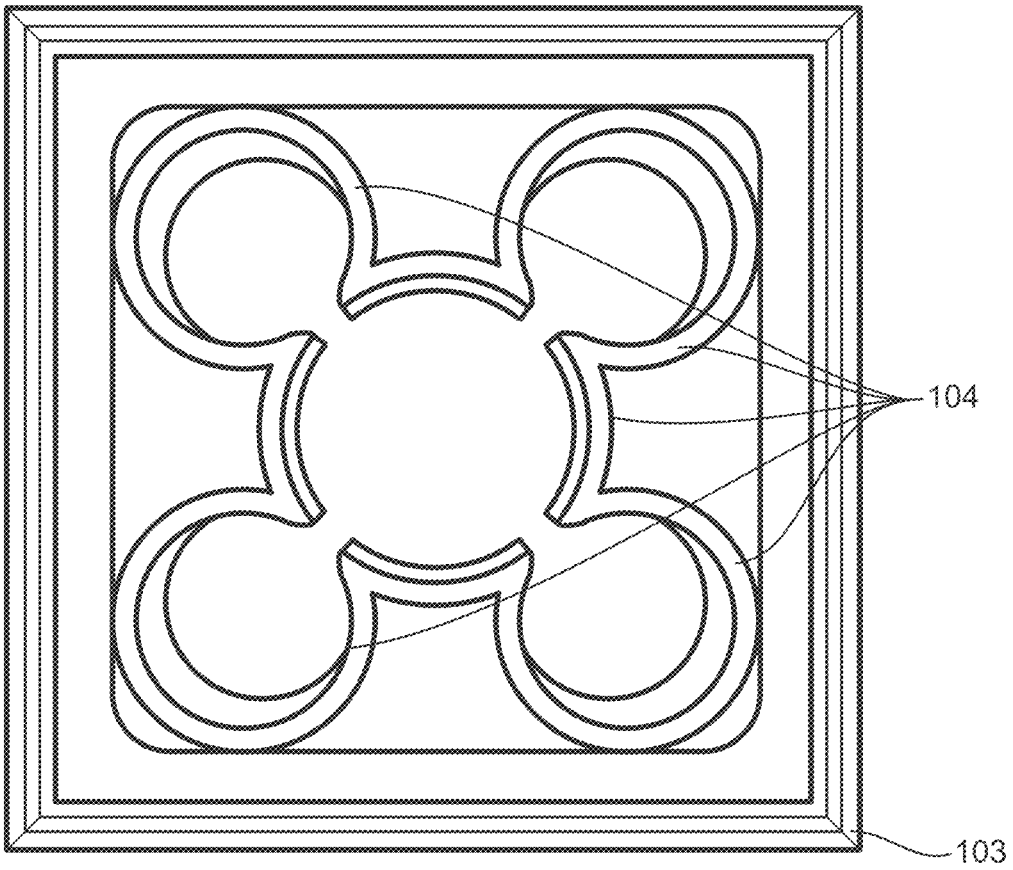
FIG. 5 is an image of the five base anchor locking cavities housed in the bottom of the base anchor.

In FIG. 4C the four secondary support sleeves 101 are arranged equidistant from each other forming a square shape in which one support sleeve 101 is in each corner of the square and the primary support sleeve 102 is situated in the center of the square, equidistant from the four secondary support sleeves 101. In FIGS. 4B-C, the support sleeves 101 and 102 are secured within base anchor 103 by five base anchor locking cavities 104 housed in the bottom of base anchor 103, as shown in FIG. 5. As showing in FIGS. 5 and 6, the secondary support sleeves 101 can be smaller in cross-sectional dimensions than the primary support sleeve 102. Those of skill in the art will appreciate that number, arrangement, size, and shape of the support sleeves could vary, such as an embodiment using six smaller support sleeves arranged in three rows of three to support a varying number, type, and weights of articles as depicted in FIGS. 14A-C and FIG. 15A-B. Furthermore the support sleeves can take the shape of an elongated hollow body with square, circular, or other suitable cross sectional shapes.

The base anchor 103 and the cap 109 can be made of polyethylene terephthalate ("PET"). PET is a thermoplastic polymer resin and has good chemical resistance and dimensional stability. PET also has low moisture absorptions features and good flow properties, making it waterproof and lightweight. Due to these qualities, base anchor 103 and cap 109 are able to withstand rain and moisture, support the structural integrity of the modular article support assembly, and contribute to the modular article support assembly's light weight.

Figure 6:
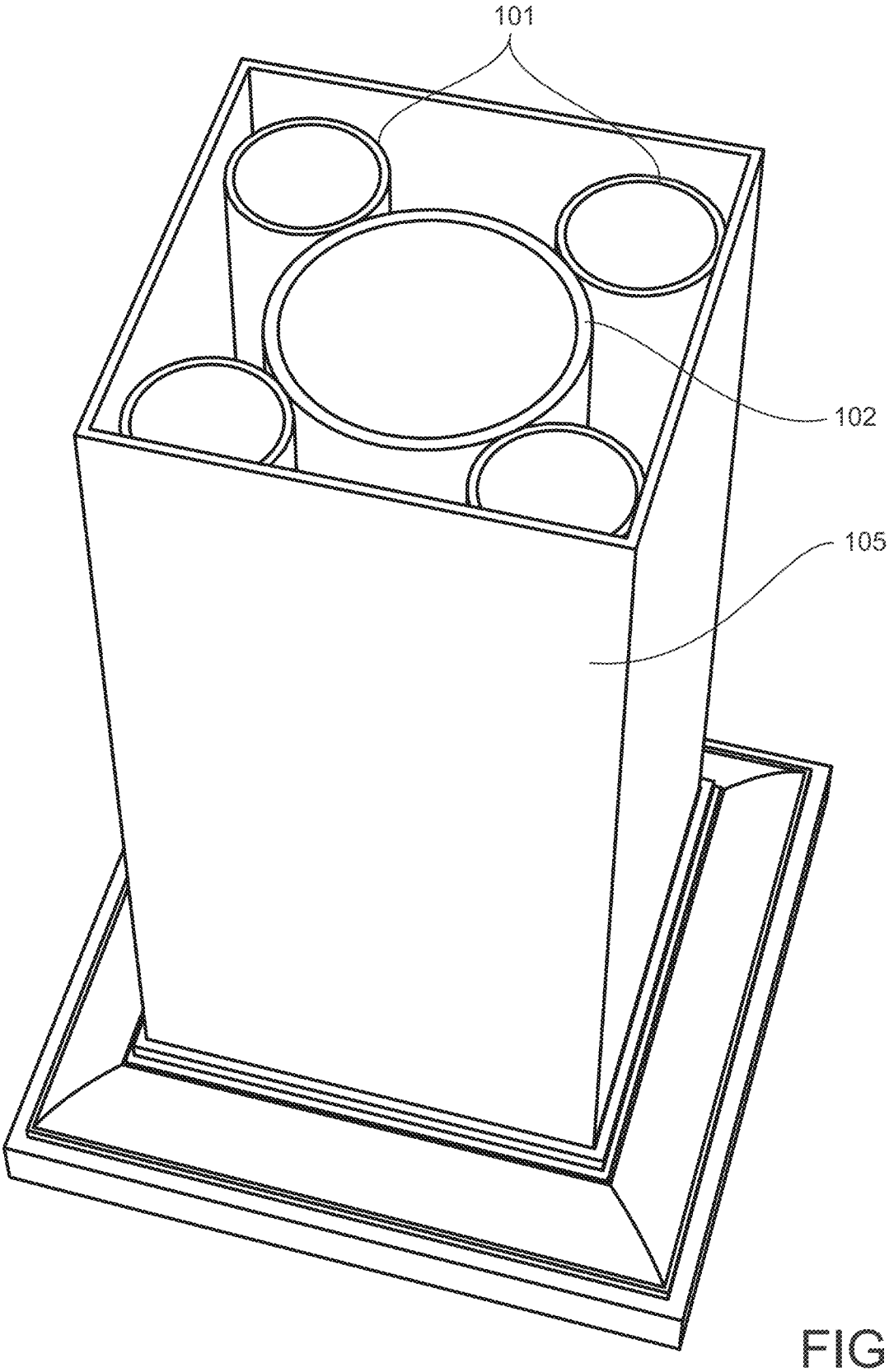
FIG. 6 is an image of the post encasing the support sleeves.
Figure 7A:
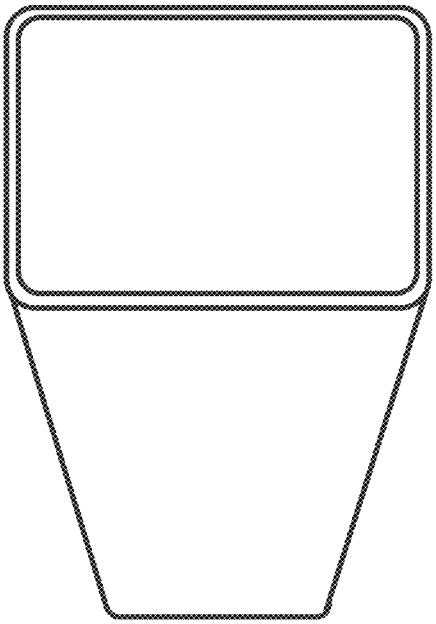
FIG. 7A is an image of the post.
Figure 7B:
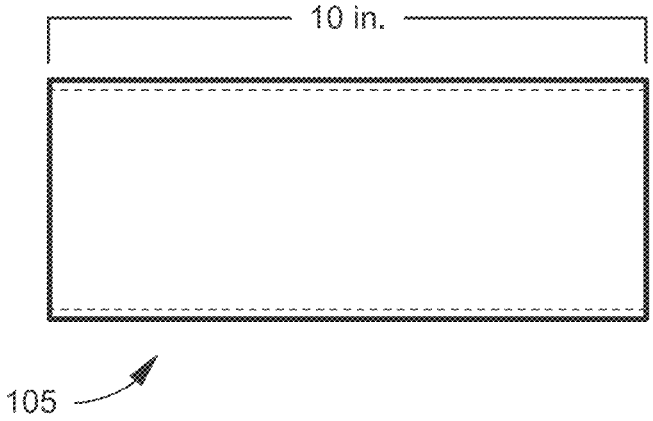
FIG. 7B is a length-wise illustration of the post.
Figure 7C:
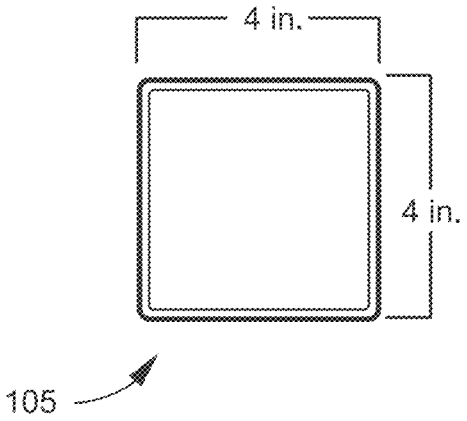
FIG. 7C is a width and height illustration of the post.

FIG. 6 shows the five support sleeves 101 and 102 encased in the post 105. The post 105 shown in the attached figures is a rectangular prism that is 10 inches in height and 4 inches in width and length and made of PVC, the dimensions of which are shown in FIGS. 7A-C. The post 105 provides additional structure and support to the modular article support assembly 100 and protects the support sleeves 101 and 102 from weather exposure and mechanical impact. The post 105 also creates a negative space between the support sleeves 101 and 102 and the post, which can house foam sealant providing additional structural support to the modular article support assembly 100. The post 105 can be formed with a square, circular, or other cross sectional shape to accommodate a particular use or application or to modify the appearance of the modular assembly.

Figure 8A:
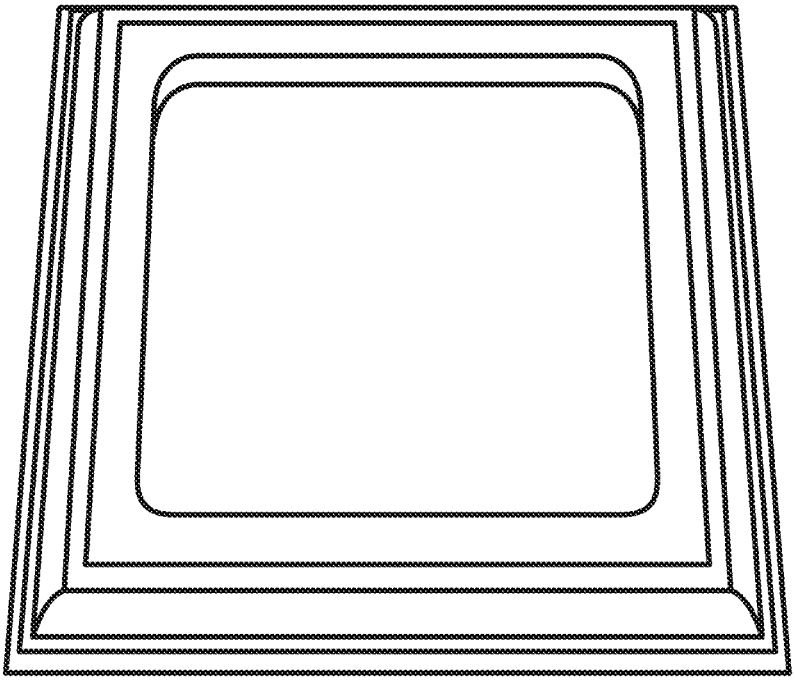
FIG. 8A is a top-down view of the skirt of the modular article support assembly.
Figure 8B:
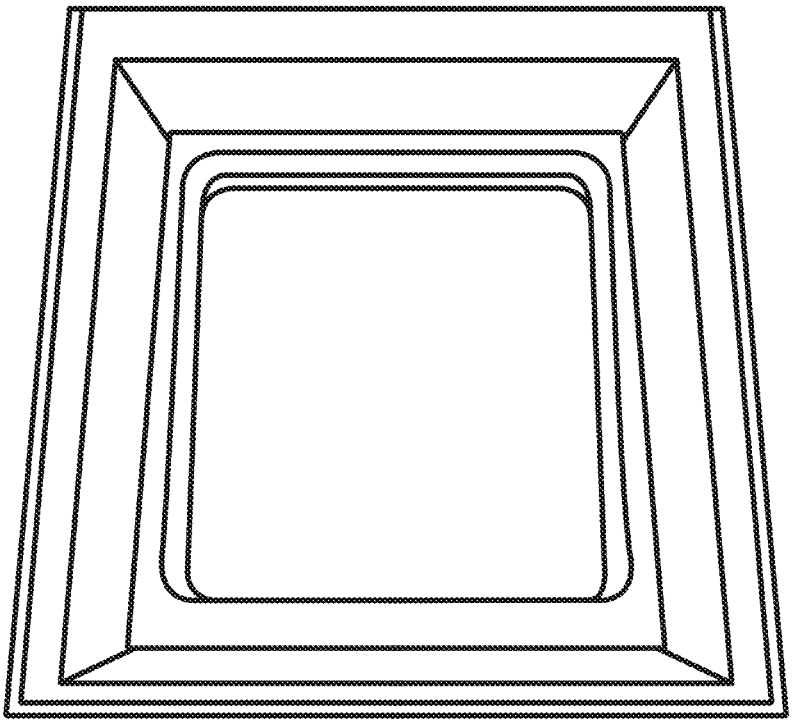
FIG. 8B is a bottom-up view of the skirt of the modular article support assembly.
Figure 9A:
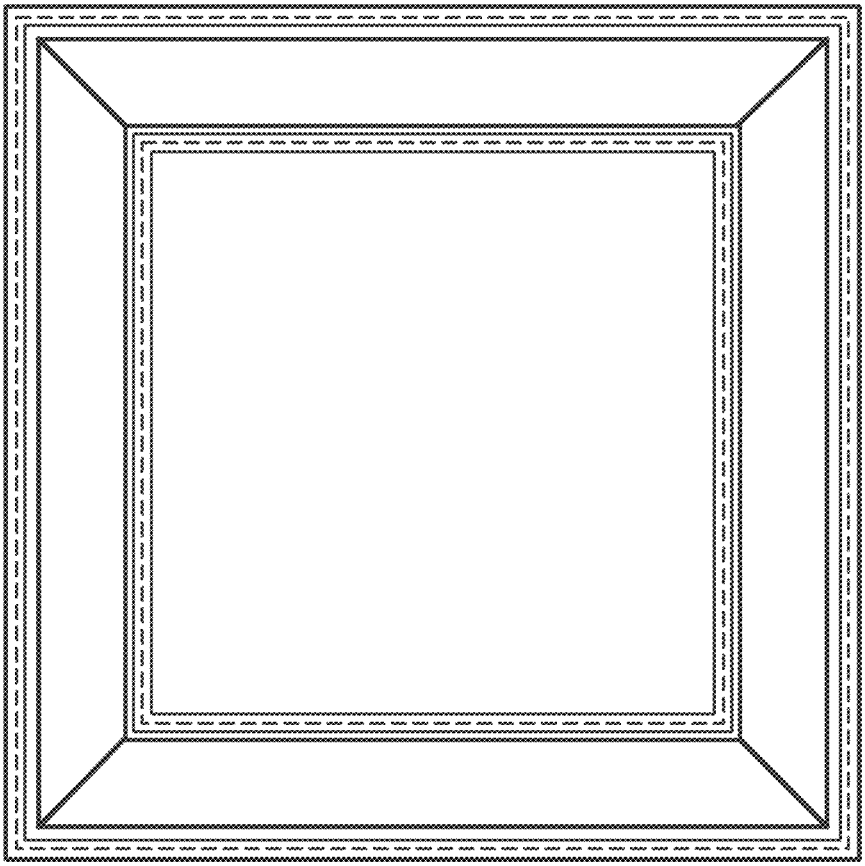
FIG. 9A is a top-down view of the skirt and foot of the modular article support assembly.
Figure 9B:
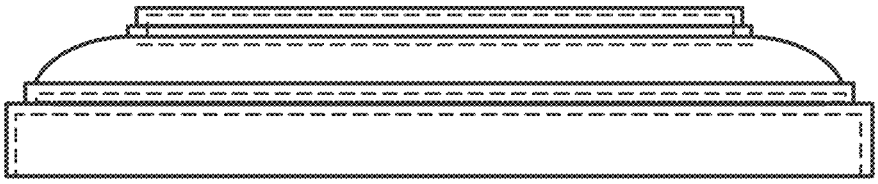
FIG. 9B is a bottom-up view of the skirt and foot of the modular article support assembly.
Figure 10A:
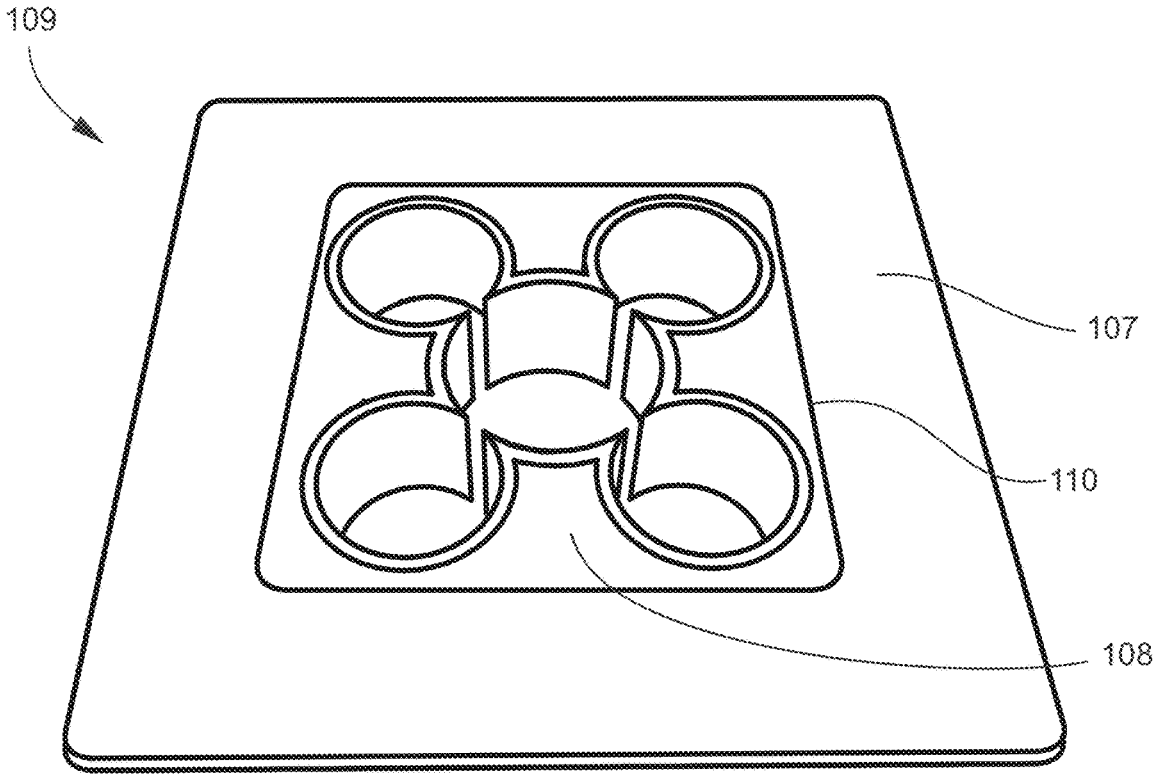
FIG. 10A is an image of outside of the cap with exposed holes.
Figure 10B:
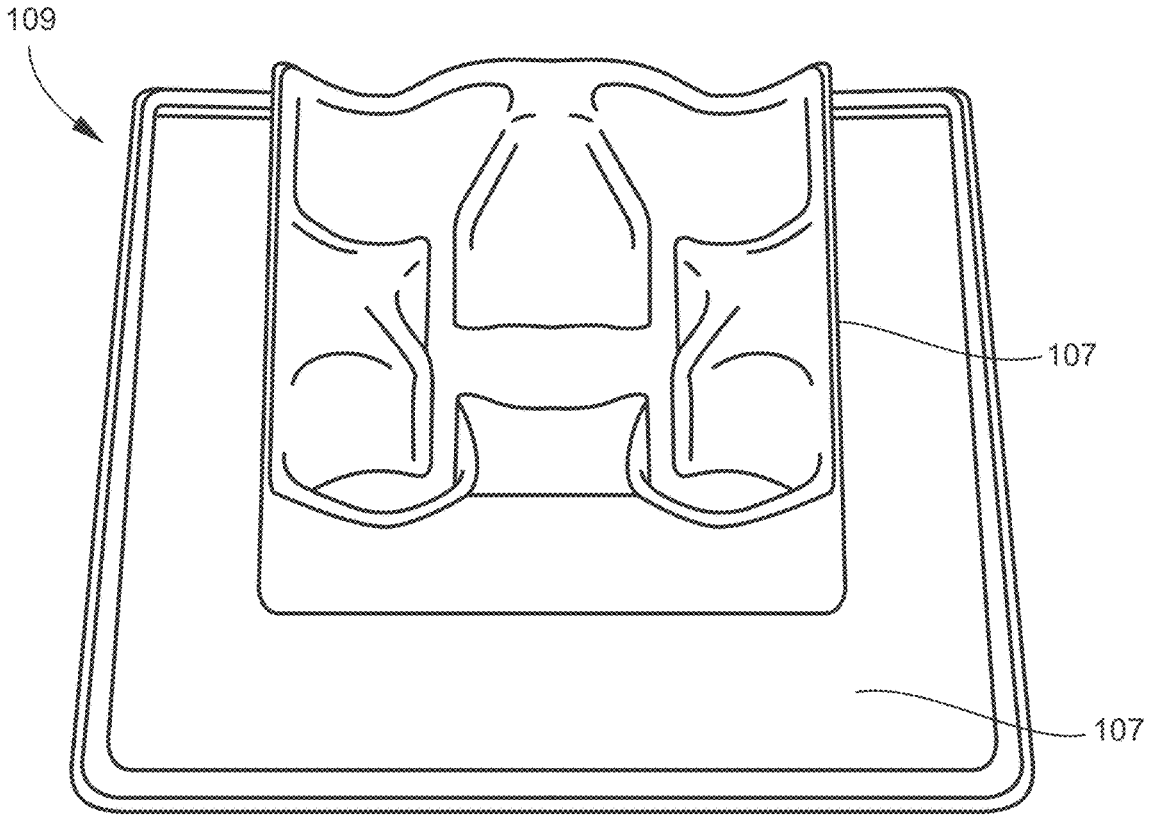
FIG. 10B is an image of inside of the cap with exposed holes.

FIGS. 8A-B show the skirt 106 that sits atop base anchor 103. The skirt 106 is frictionally engaged and secured into base anchor 103 as shown in FIGS. 9A-B. The skirt 106 provides additional base support to base anchor 103 and the modular article support assembly 100, as well as aesthetic visuals.

Figure 11A:
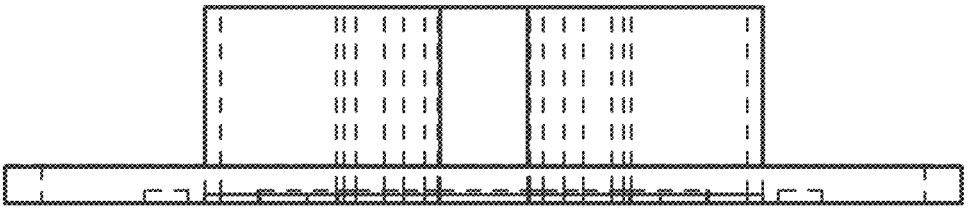
FIG. 11A is an illustration of the cap from the side.
Figure 11B:
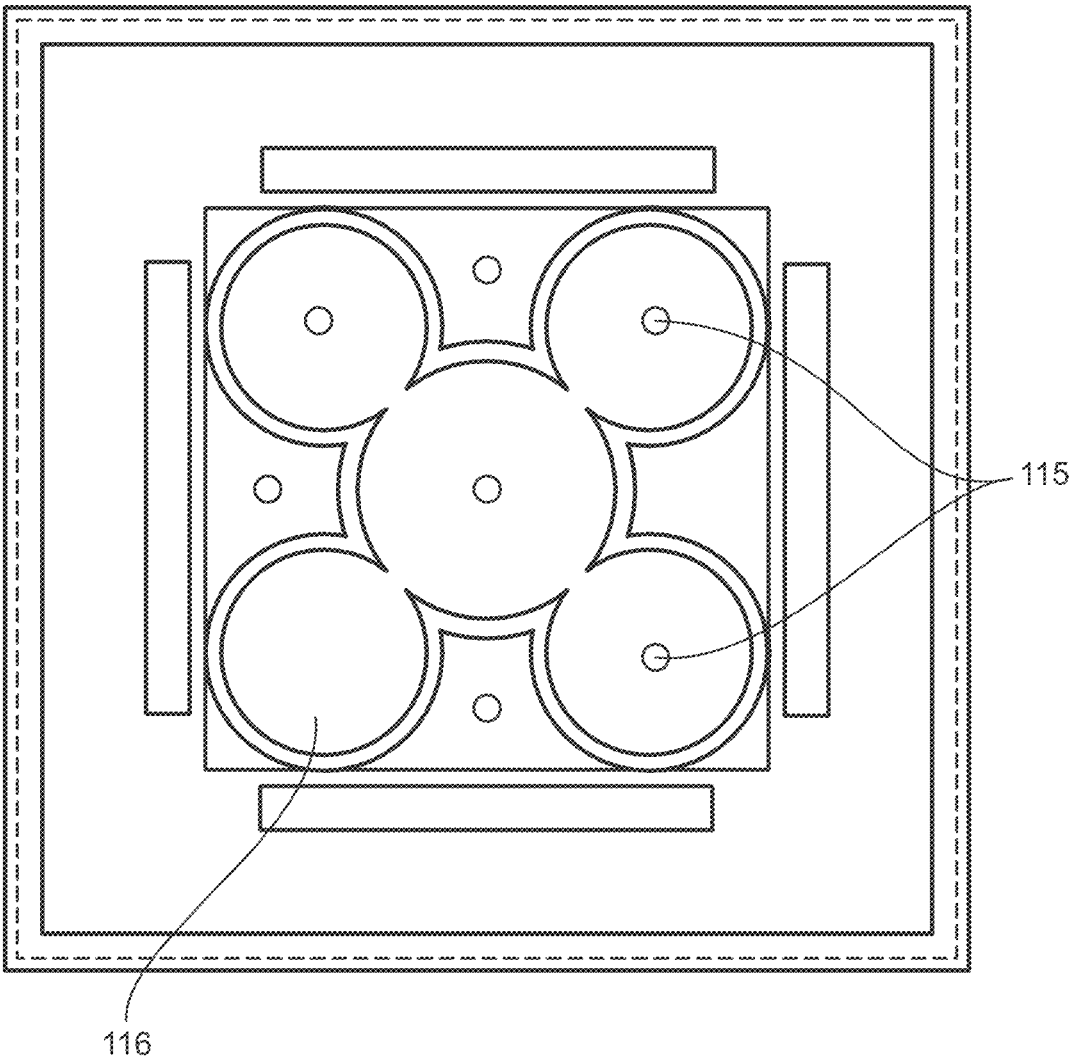
FIG. 11B is an illustration of the cap from the inside.

FIGS. 11B and 12A-B depict base anchor 103 with apertures 115. Base anchor apertures 115 allow for water and other liquids to drain through the modular article support assembly 100. Additionally, base anchor apertures 115 create holes in which the foam sealant is inserted into the modular article support assembly 100. As seen in FIGS. 11B and 12A-B an anchor element aperture 115 is located at the bottom of base anchor to accommodate the anchor element 114 for anchoring to the ground, as discussed below.

The modular article support assembly 100 also has an upper collar 107 secured to an upper anchor host 108 forming what is collectively referred to as the cap 109. As shown in FIG. 2, the cap 109 is situated on the top part of the modular article support assembly 100, above the post 105 and base anchor 103. The cap 109 can be square in shape and includes the cutouts in its center that exposes the support sleeves 101 and 102. FIGS. 1, 10A-B, and 11A-B depict various embodiments of the cap 109, consisting of the upper collar 107 secured to the upper anchor host 108. The cap 109 is used to provide additional structural support and stability to the upper portion of the modular article support assembly 100. The cap 109 can also be used to cover the inner pieces of the modular article support assembly 100 so that they are not exposed, preventing objects from falling into and getting stuck inside the modular article support assembly 100 as well as providing for a more aesthetically pleasing experience.

The cap 109 also contains a lip 110 that allows for additional attachments to sit on top of the support assembly 100. FIG. 1 shows a screen 111 that can be placed atop the cap 109 to provide additional covering to the cap 109 as well as allow for the placement of a solar panel light attachment 112. The solar panel light attachment 112 turns the modular article support assembly 100 into an illumination assembly. Additionally, a cap cover 113, as seen in FIGS. 12A-B can be frictionally engaged and secured into the cap 109. The cover 113 allows for the support sleeves 101 and 102 to be covered while leaving one exposed for use. The cover 113 prevents objects from falling into and getting stuck inside the modular article support assembly 100.

Figure 13A:
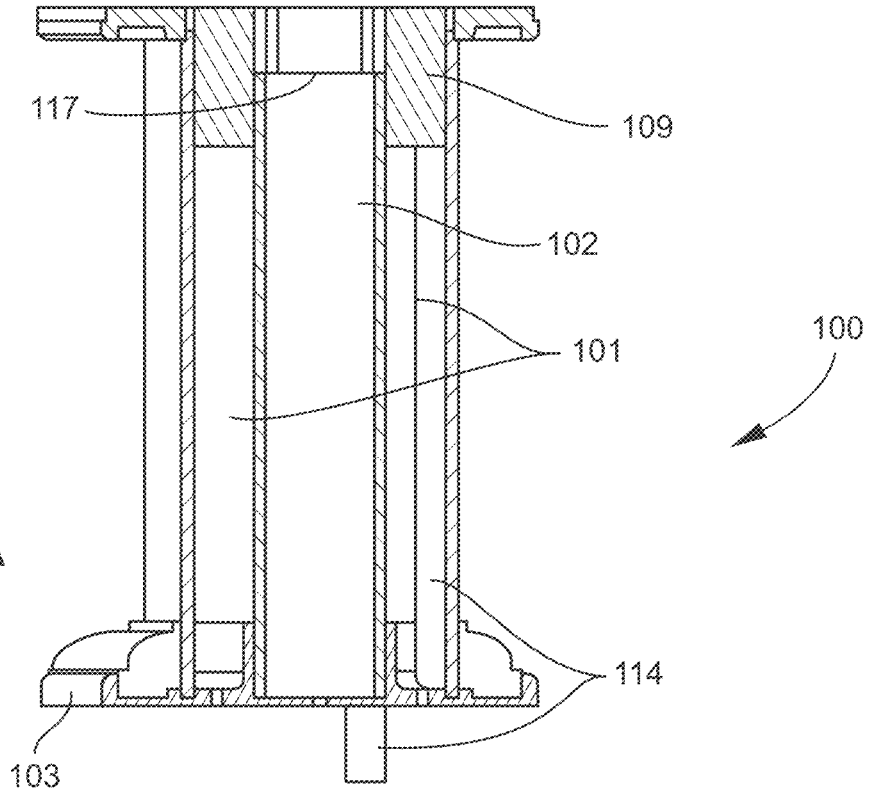
FIG. 13A a cross-section view of the modular article support assembly.
Figure 13B:
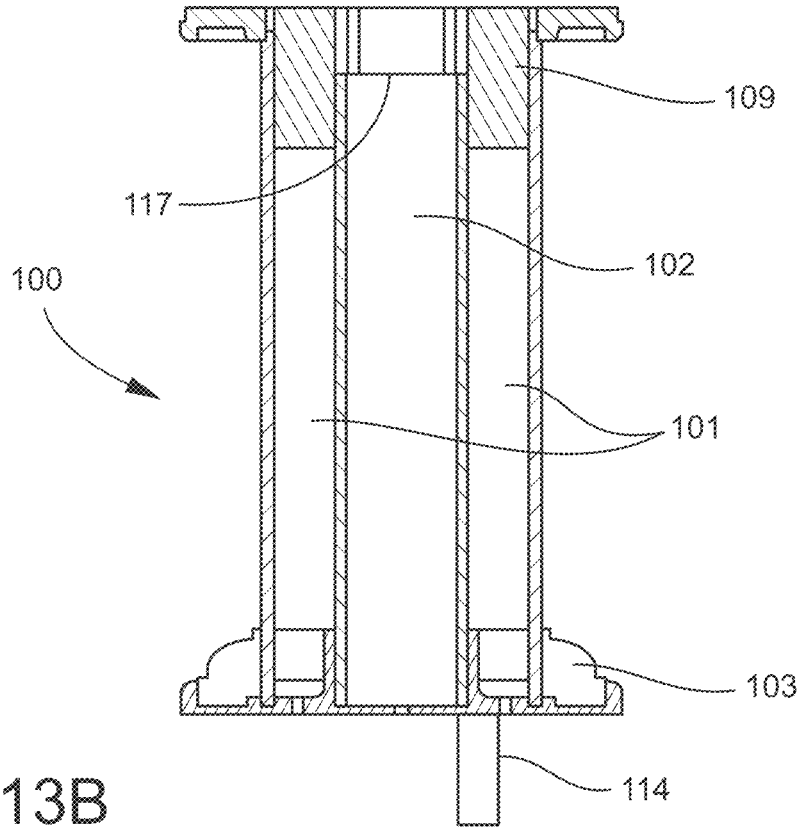
FIG. 13B a cross-section view of the modular article support assembly.
Figure 14A:
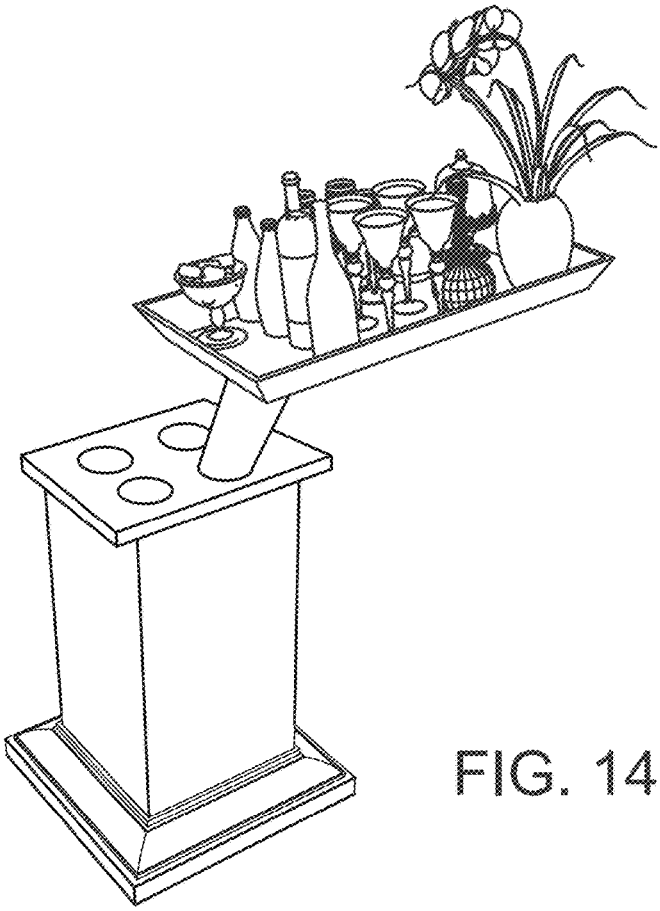
FIG. 14A shows an embodiment modular article support assembly with a tray attachment that holds food, beverages or other objects.
Figure 14B:
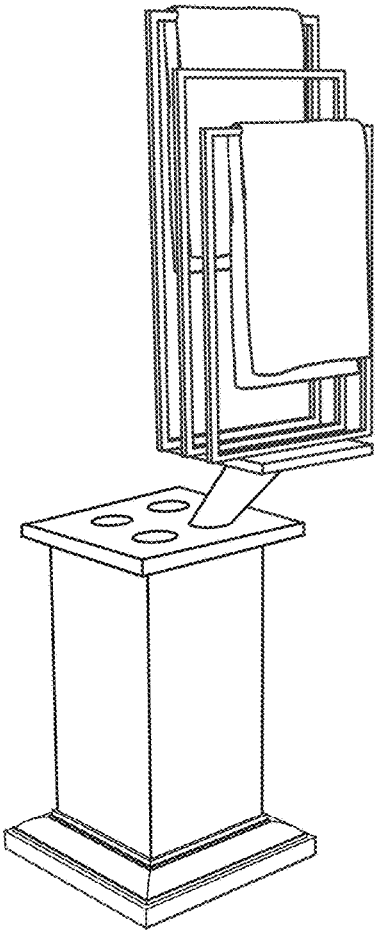
FIG. 14B shows an embodiment modular article support assembly with a towel-rack attachment and a tray that holds towels or other objects.
Figure 14C:
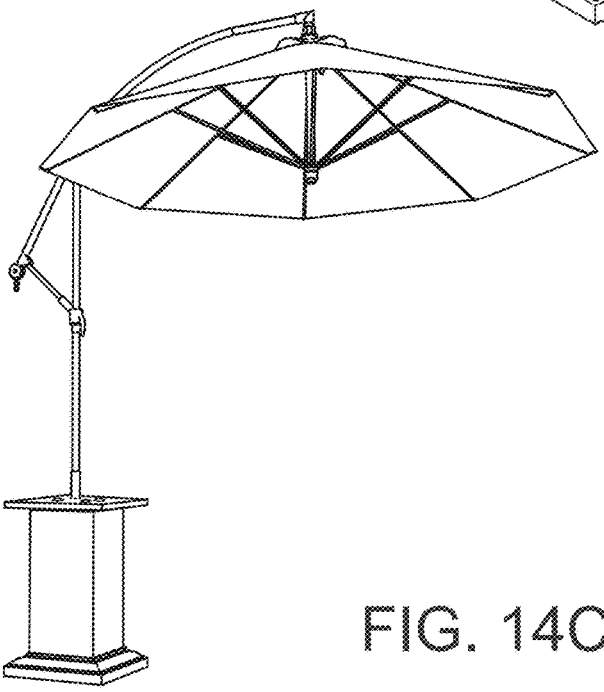
FIG. 14C shows an embodiment modular article support assembly with an umbrella attachment.

In FIG. 3, the modular article support assembly 100 includes an anchor element 114. FIG. 13A-B is a cross-section illustration of the modular article support assembly 100 that can be secured into a ground aperture by the anchor element 114. In FIGS. 3 and 13A-B, the anchor element is formed as a cylindrical rod. When a person desires to place the modular article support assembly 100 at a set location, they insert the anchor element 114 into one of the modular article support assembly's support sleeves 101 and 102. The anchor element 114 is smaller in cross-sectional dimension than the secondary support sleeve 101 and longer in length than the modular article support assembly 100.

The anchor element 114 extends from the cap 109 all the way beyond base anchor 103 and into a ground aperture or pool deck hole. The anchor element 114 can be aluminum and hollow to save weight and reduce manufacturing cost. The anchor element 114 fixes the modular article support assembly 100 into the ground and provides additional structural support. The system for securing the modular article support assembly into a ground aperture by the anchor assembly may referred to as the "Pin Anchor Lock" or "P.A.L." system.

In the P.A.L. system the anchor element 114 and support sleeves 101 and 102 are a counterbalance or counterforce to force applied to the modular article support assembly 100, such wind or force exerted any attachment that is inserted into the modular article support assembly 100. More specifically, the anchor element 114 transfers the force asserted on the modular article support assembly 100 into the ground and prevents the modular article support assembly 100 and any attachments from toppling over. This allows, for example, the modular article support assembly 100 to withstand the force of strong winds or mechanical force, including the weight of attachments. Furthermore, the P.A.L. systems aids in the light weight of the assembly by strategically transferring the force applied to the modular article support assembly into the ground. Put another way, by transferring force, the modular article support assembly 100 does not require additional weight to counter the force that would otherwise be required to handle such weight.

The upper anchor host 108, base anchor 103, and the negative space between the support sleeves 101 and 102 and the post 105 can be filled with foam sealant. The foam sealant increases the stability of the structure. The foam sealant also decreases materials, time for production, and manufacturing costs.

Figure 15A:
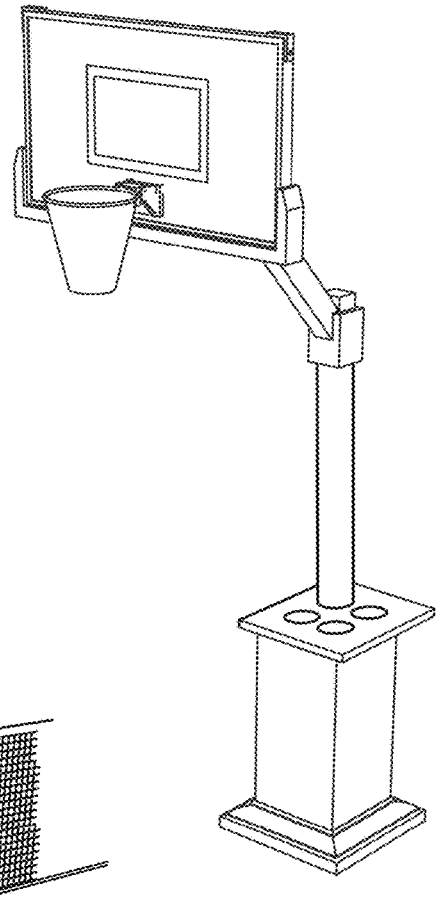
FIG. 15A shows an embodiment modular article support assembly with a basketball hoop and backboard attachment.
Figure 15B:
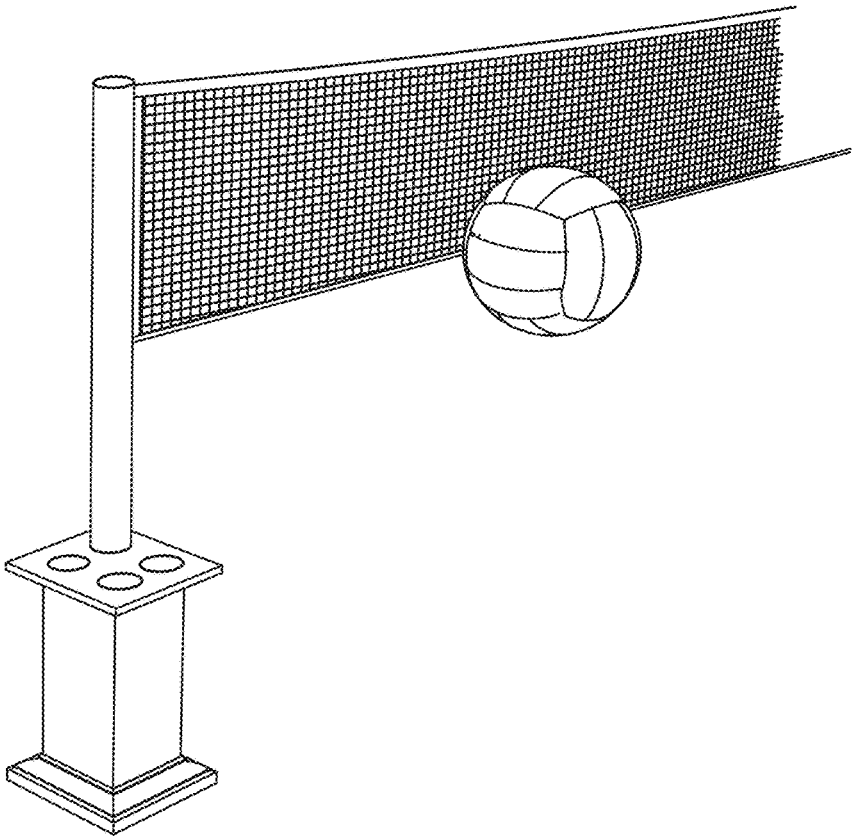
FIG. 15B shows an embodiment modular article support assembly with a volleyball net attachment.

In FIGS. 14A-C and 15A-B, the modular article support assembly 100 can be used with one or more assemblies or attachments, and such assemblies can be adjacent to one another to provide additional support for larger objects. Such objects can include, but are not limited to: a table or elongated arm that can hold a tray with multiple storage compartments for food, fasteners, or other objects (FIG. 14A); a straight rod or dowel like attachment to be used, for example, as a towel rack (FIG. 14B); an elongated arm that holds, among other things, an umbrella (FIG. 14C); basketball hoop and backboard (FIG. 15A); or volleyball net (FIG. 15B). The assemblies are inserted into one of the five openings of the cap and secured into the corresponding support sleeve. Additionally, as depicted in FIGS. 13A-B the top surface of the primary support sleeve 102 is inset to the cap 109, creating a ridge 117. When an attachment is inserted into the primary support sleeve 102, additional articles can be stacked on top of the attachment and the ridge 117.

Those skilled in the art will appreciate that the modular article support assembly can be manufactured in a variety of different manners. For example, the modular article support assembly can be made by 3D printing or additive manufacturing. As another example, the modular article support assembly can be made by injection molding and its variations. The modular article support assembly could also be manufactured by blow molding, compression molding, rotational molding, or vacuum casting.

Those of skill in the art will appreciate that various types of thermoplastics can be used to form the components of the modular article support assembly 100, including, but not limited to, various acrylic monomers or polymers, acrylonitrile butadiene styrene ("ABS"), polylactide, polybenzimidazole ("PBI"), polycarbonate, polyether sulfone ("PES"), polyoxymethylene ("POM"), polyether ether ketone ("PEEK"), polyetherimide ("PEI"), polyethylene, polyphenylene oxide ("PPO"), polyphenylene sulfide ("PPS"), polypropylene, polystyrene, polyvinyl chloride ("PVC"), polyvinylidene fluoride, and Teflon®. The modular article support assembly 100 components can also be made of various metal and metal alloys, such as steel or aluminum.

Although the foregoing description provides embodiments of the invention by way of example, it is envisioned that other embodiments may perform similar functions and/or achieve similar results. Any and all such equivalent embodiments and examples are within the scope of the present invention.

What is claimed is:

1. A modular article support assembly comprising:
(a) a primary support sleeve and four secondary support sleeves that are each arranged adjacent to the primary support sleeve, wherein the primary support sleeve and the four secondary support sleeves are each coupled to five base anchor locking cavities housed in a base anchor situated at a bottom portion of the modular article support assembly;
(b) an upper collar secured into an upper anchor host situated at an upper portion of the modular article support assembly;
(c) a skirt frictionally engaged and secured to the base anchor; and
(d) a post having a rectangular cross section and a length, wherein
(i) the post houses the entire length of the secondary support sleeves and the primary support sleeve,
(ii) the post is fixed to the base anchor and upper anchor host, and
(iii) an elongated tubular anchor element is inserted through one of the four secondary support sleeves and into a ground aperture to secure the modular support assembly by preventing the modular support assembly from translating about a ground surface surrounding the ground aperture.

2. A modular article support assembly of claim 1, wherein foam sealant is applied to a negative space between the four secondary support sleeves, the one primary support sleeve and the post, the base anchor, the upper collar, and the upper anchor host.

3. A modular article support assembly of claim 1, wherein the four secondary support sleeves, the one primary support sleeve, and the post are comprised of polyvinyl chloride.

4. A modular article support assembly of claim 1, wherein the four secondary support sleeves have cross-sectional dimensions smaller than the primary support sleeve.

5. A modular article support assembly of claim 1, wherein the upper collar, the upper anchor host, and the base anchor are comprised of polyethylene terephthalate.

6. A modular article support assembly of claim 1, wherein one or more attachments is inserted into one of the four secondary support sleeves or the one primary support sleeve.

7. A modular article support assembly of claim 6, wherein the attachment is selected from one of (i) a table or elongated arm; (ii) a straight rod attachment; (iii) an elongated arm; (iv) basketball hoop; (v) volleyball net.

8. A modular article support assembly comprising:

(a) five support sleeves, wherein (i) each support sleeve comprises a first end, a length, and a second end opposite the first end, (ii) a first end of each support sleeve is inserted into a base anchor cavity, (iii) the support sleeve extends outward from the base anchor cavity, (iv) the second end is coupled to an upper anchor host, and (v) the upper anchor host comprises five cutouts that accommodate the second end of the support sleeves wherein the cutouts have a cross sectional area that is larger than a cross sectional area of the support sleeves, and the cutouts have a height such that the second end of the support sleeves sit a depth below a top surface of the upper anchor host;

(b) an upper collar secured to the upper anchor host;

(c) a skirt frictionally engaged and secured into the top portion of the base anchor; and (d) a post formed as a hollow body that cover and is secured about the entire length of the support sleeves and fixed to the base anchor and upper anchor host, wherein (e) when an anchor element is inserted through one of the support sleeves and into a ground aperture, the modular article support assembly is secured into a ground and held in place.

9. A modular article support assembly of claim 8, wherein foam sealant is applied to a negative space between the support sleeves and the post, the base anchor, and the upper anchor host.

10. A modular article support assembly of claim 8, wherein the support sleeves are comprised of polyvinyl chloride.

11. A modular article support assembly of claim 8, wherein the post is comprised of polyvinyl chloride.

12. A modular article support assembly of claim 8, the upper collar, the upper anchor host, and the base anchor are comprised of polyethylene terephthalate.

13. A modular article support assembly of claim 8, wherein one or more attachments is inserted into one of the support sleeves.

14. A modular article support assembly of claim 13, wherein the attachment is selected from one of the following (i) a table or elongated arm; (ii) a straight rod or dowel like attachment; (iii) an elongated arm; (iv) basketball hoop; (v) volleyball net.

15. A modular article support assembly of claim 1, wherein the secondary support sleeves have a smaller cross sectional area than the primary support sleeve to accommodate varying sizes of attachments.

16. A modular article support assembly comprising:

(a) five support sleeves, wherein one end of each support sleeve is inserted into a base anchor and the other end is inserted into an upper anchor host;

(b) an upper collar secured into the upper anchor host; and (c) a post formed as a rectangular prism between seven to ten inches in length, a height between three to five inches, and a width between three to five inches is secured about the entire length of the support sleeves and fixed to the base anchor and upper anchor host.

17. A modular article support assembly of claim 16, wherein the five support sleeves are inserted into five base anchor locking cavities housed in the bottom of the base anchor.

18. A modular article support assembly of claim 17, wherein an anchor element, with an element length greater than a height of the modular article support assembly, is inserted through one of the support sleeves and into a ground aperture, the modular article support assembly is secured into the ground and held in place.

19. A modular article support assembly of claim 18, wherein one or more attachments is inserted into one of the support sleeves.

20. A modular article support assembly of claim 19, wherein the attachment is selected from one of: towel racks; cellular phone or other mobile device holders; beverage holders; tabletops that span multiple assemblies; trays for holding food, tools, sunscreen, or other objects; and support posts for decorative or communicative objects, such signage bearing safety information, directional information, identifying information, or decorative flags for a favorite sports team or organization.

* * * * *